US011189936B2

(12) United States Patent
Verd et al.

(10) Patent No.: US 11,189,936 B2
(45) Date of Patent: Nov. 30, 2021

(54) SLOT-FED DUAL HORSE SHOE CIRCULARLY-POLARIZED BROADBAND ANTENNA

(71) Applicant: United States Government as represented by the Secretary of the Navy, San Diego, CA (US)

(72) Inventors: Frederick Joseph Verd, Santee, CA (US); John Harold Meloling, San Diego, CA (US); Terence R. Albert, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 141 days.

(21) Appl. No.: 16/718,692

(22) Filed: Dec. 18, 2019

(65) Prior Publication Data

US 2021/0159608 A1 May 27, 2021

Related U.S. Application Data

(60) Provisional application No. 62/941,536, filed on Nov. 27, 2019.

(51) Int. Cl.
*H01Q 21/06* (2006.01)
*H01Q 9/26* (2006.01)
(Continued)

(52) U.S. Cl.
CPC ..... *H01Q 21/062* (2013.01); *H01Q 9/045* (2013.01); *H01Q 9/0428* (2013.01);
(Continued)

(58) Field of Classification Search
CPC .... H01Q 21/062; H01Q 21/065; H01Q 21/06; H01Q 15/14; H01Q 9/265; H01Q 9/285;
(Continued)

(56) References Cited

U.S. PATENT DOCUMENTS 6,054,953 A * 4/2000 Lindmark ..... H01Q 1/38 343/700 MS
9,954,288 B2 * 4/2018 Luk ..... H01Q 9/065
(Continued)

FOREIGN PATENT DOCUMENTS

CN 110444880 A * 11/2019

OTHER PUBLICATIONS

A kind of flexibility ultra wide band circular polarized antenna (English) ip.com—CN 110444880 A Published On Nov. 12, 2019 (Year: 2019).*

(Continued)

*Primary Examiner* — Vibol Tan

(74) *Attorney, Agent, or Firm* — Naval Information Warfare Center, Pacific; Kyle Eppele; Evan Hastings

(57) ABSTRACT

An antenna comprising: first and second dielectric layers; a conductive slot layer disposed between the first and second dielectric layers, wherein the slot layer has a slot therein with short and long axes of symmetry; a pair of arcs, rotated 180° from each other, made of conductive material, and disposed on top of the first dielectric layer, wherein proximal ends of the arcs are vertically-aligned with the short axis of symmetry and equidistant from the long axis of symmetry and electrically connected to the slot layer through vias in the first dielectric layer; and a forked feed made of conductive material disposed on the bottom of the second dielectric layer, wherein the forked feed has a centerline that is vertically-aligned with the short axis of symmetry.

20 Claims, 5 Drawing Sheets

(51) Int. Cl.
*H01Q 15/14* (2006.01)
*H01Q 9/04* (2006.01)
*H01Q 9/06* (2006.01)

(52) U.S. Cl.
CPC ..... *H01Q 9/0492* (2013.01); *H01Q 9/065* (2013.01); *H01Q 9/265* (2013.01); *H01Q 15/14* (2013.01)

(58) Field of Classification Search
CPC .... H01Q 9/0435; H01Q 19/10; H01Q 9/0407; H01Q 9/0428; H01Q 9/0492; H01Q 9/065
See application file for complete search history.

(56) References Cited

U.S. PATENT DOCUMENTS

| | | | | |
|---|---|---|---|---|
| 10,581,177 | B2 * | 3/2020 | Isom | H01Q 9/0492 |
| 10,804,609 | B1 * | 10/2020 | Nosrati | H01Q 9/0428 |
| 2020/0287277 | A1 * | 9/2020 | Wang | H01Q 1/48 |

OTHER PUBLICATIONS

Li, Ronglin et al.; Bandwidth and Gain Improvement of a Circularly Polarized Dual-Rhombic Loop Antenna; IEEE Antennas and Wireless Propagation Letters, vol. 5 (2006).
Morishita, H et al.; A Wideband Circularly Polarized Dipole Antenna; IEEE 0-7803-4478-2/98, p. 2348 (1998).

* cited by examiner

SLOT-FED DUAL HORSE SHOE CIRCULARLY-POLARIZED BROADBAND ANTENNA

CROSS-REFERENCE TO RELATED APPLICATION

This application claims the benefit of prior U.S. Provisional Application No. 62/941,536, filed 27 Nov. 2019, titled "Slot-Fed Dual Horse Shoe Circularly-Polarized Broadband Antenna" (Navy Case #106420).

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 106420.

BACKGROUND OF THE INVENTION

Antennas that are flat enough to support Satellite antenna systems and satellite mechanical specifications tend to be narrow band and lack radiation patterns broad enough to transmit and receive at broad angles. There is a need for an antenna that is broadband, circularly polarized, has improved gain over previous antenna designs, and that supports a wider radiation pattern than the typical antenna manufactured from printed circuit board (PCB) materials.

SUMMARY

Disclosed herein is a PCB-manufacture-able, broadband, circularly polarized antenna with improved gain that comprises a first dielectric layer, a slot layer, a pair of arcs, a second dielectric layer, and a forked feed. The slot layer is conductive and is disposed on a bottom surface of the first dielectric layer. In the slot layer there is a slot that has short and long axes of symmetry. The pair of arcs are made of conductive material and are disposed on a top surface of the first dielectric layer. The arcs are rotated 180° from each other and each arc has a distal end and a proximal end. The proximal ends are vertically-aligned with the short axis of symmetry and are equidistant from the long axis of symmetry. The proximal ends are electrically connected to the slot layer through vias in the first dielectric layer. The slot layer is disposed between the top surface of the second dielectric layer and the bottom surface of the first dielectric layer. The forked feed is made of conductive material disposed on the bottom surface of the second dielectric layer. The forked feed has a centerline that is vertically-aligned with the short axis of symmetry.

The antenna disclosed herein may also be described as comprising a slot layer, a pair of conductive arcs, and a feed conductor. The slot layer has a rectangular slot cut therein. The pair of conductive arcs are separated from the slot layer by a first dielectric layer. Proximal ends of the arcs are connected to the slot layer through vias in the first dielectric layer. The arcs are shaped and oriented with respect to each other and the rectangular slot so as to induce circular polarization and to function as an impedance matching device between the slot layer and air/space. The feed conductor is separated from the slot layer by a second dielectric layer such that the slot layer is disposed between the first and second dielectric layers. The feed conductor is shaped and oriented with respect to the rectangular slot so as to function as an impedance matching device between incoming radio frequency radiation (RF) and the rectangular slot.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed antenna below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
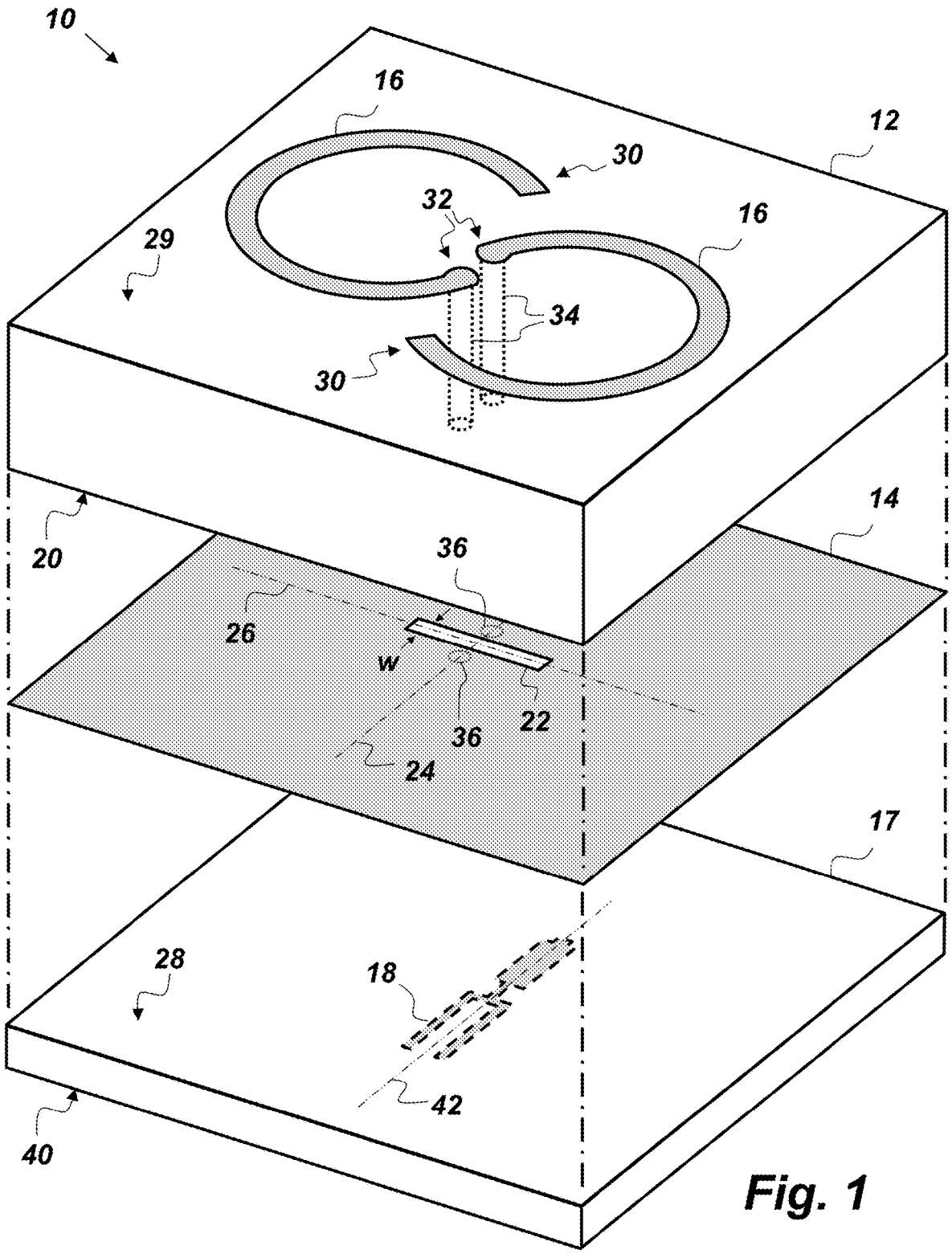
FIG. 1 is an expanded, perspective-view of an embodiment of a slot-fed antenna.
Figure 2A:
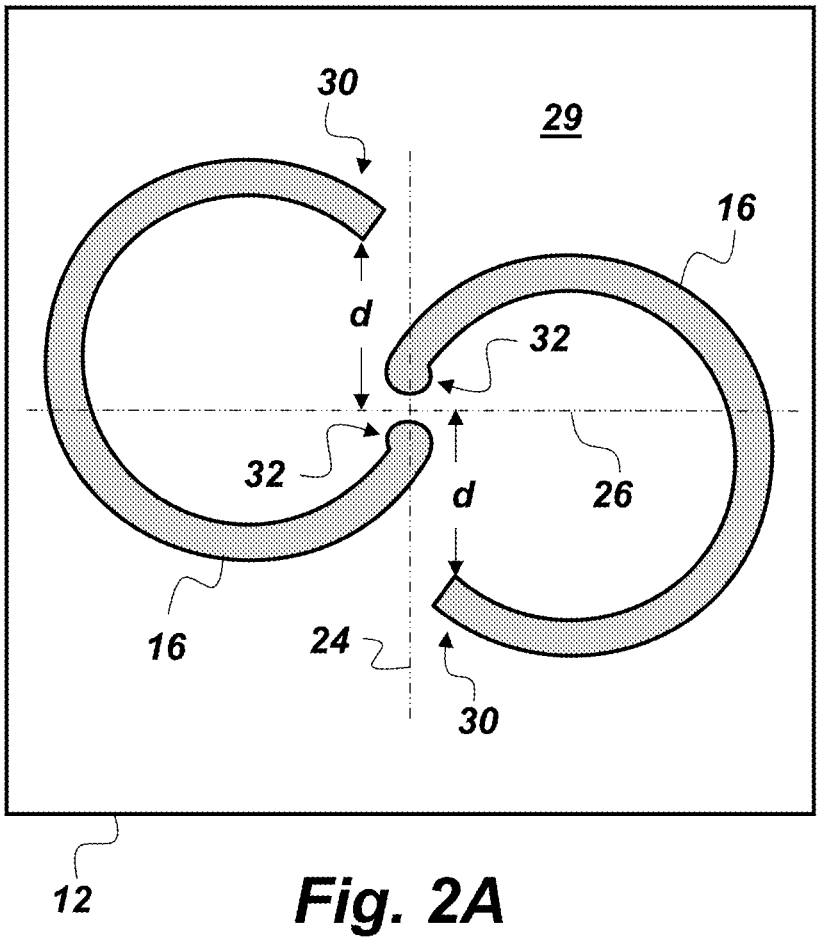
FIG. 2A is a top-view of an embodiment of a slot-fed antenna.
Figure 2B:
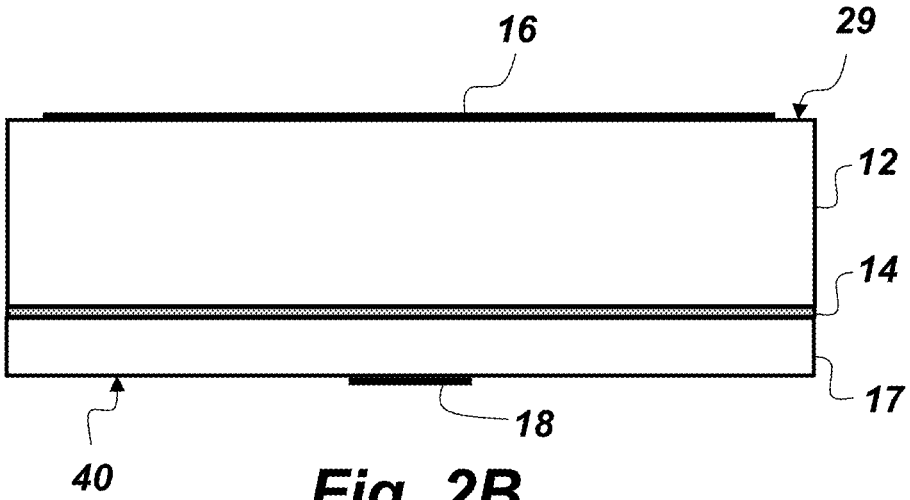
FIG. 2B is a side-view of an embodiment of a slot-fed antenna.

FIGS. 1, 2A, and 2B are respectively an expanded view, a top view, and a side view of an embodiment of a slot-fed antenna 10 that is PCB-manufacture-able, broadband, and circularly polarized. The slot-fed antenna 10 may be used in any environment where a low-profile, broadband, circularly polarized is desired, such as for satellite communications. The slot-fed antenna 10 comprises, consists of, or consists essentially of a first dielectric layer 12, a slot layer 14, a pair of arcs 16, a second dielectric layer 17, and a forked feed 18. While the first and second dielectric layers 12 and 17 are shown in FIG. 1 as being rectangular, it is to be understood that the shapes of the first and second dielectric layers 12 and 17 are not so limited. The first and second dielectric layers 12 and 17 may have any desired size and shape and may be made of any material having a dielectric constant between 1 and 30, with a preferable range between 2 and 4.4. Suitable examples of material from which the first and second dielectric layers 12 and 17 may be made is, but is not limited to, PCB material, and high density foam. The first and second dielectric layers 12 and 17 need not be made of the same dielectric material. The thickness of the first and second dielectric layers 12 and 17 is driven by the desired performance characteristics of the slot-fed antenna 10. In one embodiment of the slot-fed antenna 10, the first dielectric layer is a high-density foam block and two holes are drilled through the high density foam block where two metal rods connect the slot layer 14 to the antenna elements, or arcs 16. The metal rods could be soldered to the slot layer 14, then the foam block ($1^{st}$ dielectric layer 12) could be glued to the slot layer 14. Then, the arcs 16 could be glued to the foam block, and then the metal rods could be soldered to the arcs 16.

The slot layer 14 is conductive and is disposed on a bottom surface 20 of the first dielectric layer 12. The slot layer 14 has a slot 22 therein. In the embodiment of the slot-fed antenna 10 shown in FIG. 1, the slot 22 is rectangular and has a short axis of symmetry 24 and a long axis of symmetry 26. However, it is to be understood that the slot 22 is not limited to rectangular geometries, but may be any shape having short and long axes of symmetry. The slot layer 14 may be any desired size and shape and may be made of any conductive material. For example, a suitable example of material from which the slot layer 14 may be made, is, but is not limited to, copper. The slot layer 14 is disposed between a top surface 28 of the second dielectric layer 17 and the bottom surface 20 of the first dielectric layer 12.

The pair of arcs 16 are made of conductive material and are disposed on a top surface 29 of the first dielectric layer 12. The arcs are rotated 180° from each other and each arc 16 has a distal end 30 and a proximal end 32. As shown in FIG. 2A, the proximal ends 32 are vertically-aligned with the short axis of symmetry 24 and are equidistant from the long axis of symmetry 26. The proximal ends 32 are electrically connected to the slot layer 14 through vias 34 in the first dielectric layer 12. The dotted circles 36 in FIG. 1 show where the arcs 16 in this embodiment are connected to the slot layer 14. The arcs 16 may be connected to the slot layer 14 via soldering, welding, gluing, or any other way of establishing an electrical connection as is known in the art. The arcs 16 may be circular, elliptical, or follow another curve. In one embodiment, the arcs may be shaped like calk-less horse shoes, such as is shown in FIGS. 1 and 2A. For example, in one embodiment, each arc is circular and subtends an angle of approximately 270°±25° at the center of a circle. The arcs 16 are disposed on the top surface 29 of the first dielectric layer so as to form a circularly polarizing antenna. The slot-fed antenna 10 may be left-hand or right-hand circularly polarized. The arcs 16 may also be arranged to provide elliptical polarization. The arcs 16 may be made of any conductive material. Suitable examples of material from which the arcs 16 may be made include, but are not limited to, copper and gold-plated copper. The sizes of the arcs 16, which are the radiating elements, are subject to the frequencies desired to radiate. The lower the frequency, the larger the antenna. As shown in FIGS. 1 and 2A, the proximal ends 32 of the arcs 16 are offset from each other by greater than a width w of the slot 22. The arcs 16 are shaped and oriented with respect to each other and the slot 22 so as to induce circular polarization and to function as an impedance matching device between the slot layer 14 and air/space. The distal end 30 of each arc 16 is positioned on the first dielectric layer 12 with respect to the slot 22 so as to cancel out an energy field emanating from the slot 22 such that there is minimal frequency interaction between the distal ends 30 and the slot 22.

The forked feed 18 (or feed conductor) is made of conductive material and is disposed on a bottom surface 40 of the second dielectric layer 17. The forked feed 18 has a centerline 42 that is vertically-aligned with the short axis of symmetry 24. The forked feed 18 may be made of any conductive material. For example, a suitable example of material from which the forked feed 18 may be made, is, but is not limited to, copper. The forked feed 18 is separated from the slot layer 14 by the second dielectric layer 17. The forked feed 18 is shaped and oriented with respect to the slot 22 so as to function as an impedance matching device between incoming radio frequency radiation (RF) and the slot 22.

The slot-fed antenna 10 shown in the figures and described herein is flat and compact, which also supports satellite requirements or communication systems that have limited space for antennas. The slot-fed antenna 10 is slot-fed which eliminates phase matching issues when transitioning electromagnetic fields from transmission lines to antennas. The feed and slot size are carefully designed to support the best phase response and electromagnetic field exchange from transmission line balun, to slot, then to dual feed antenna elements. The size selected for these structures support the bandwidth of the antenna system. The type of metal and PCB material used in manufacturing can vary depending on desired performance. The slot-fed antenna 10 supports the transition from linear to circular polarization.

Many slot-fed antennas 10 may be used together in an array so as to form a passive, retro-reflective antenna array for RF energy. Passive, in that no power sources other than incoming RF energy is required to generate a return signal in the direction of the incoming RF energy. The slot-fed antenna 10 may also be used in a phased-array for communications or radar applications.

Figure 3:
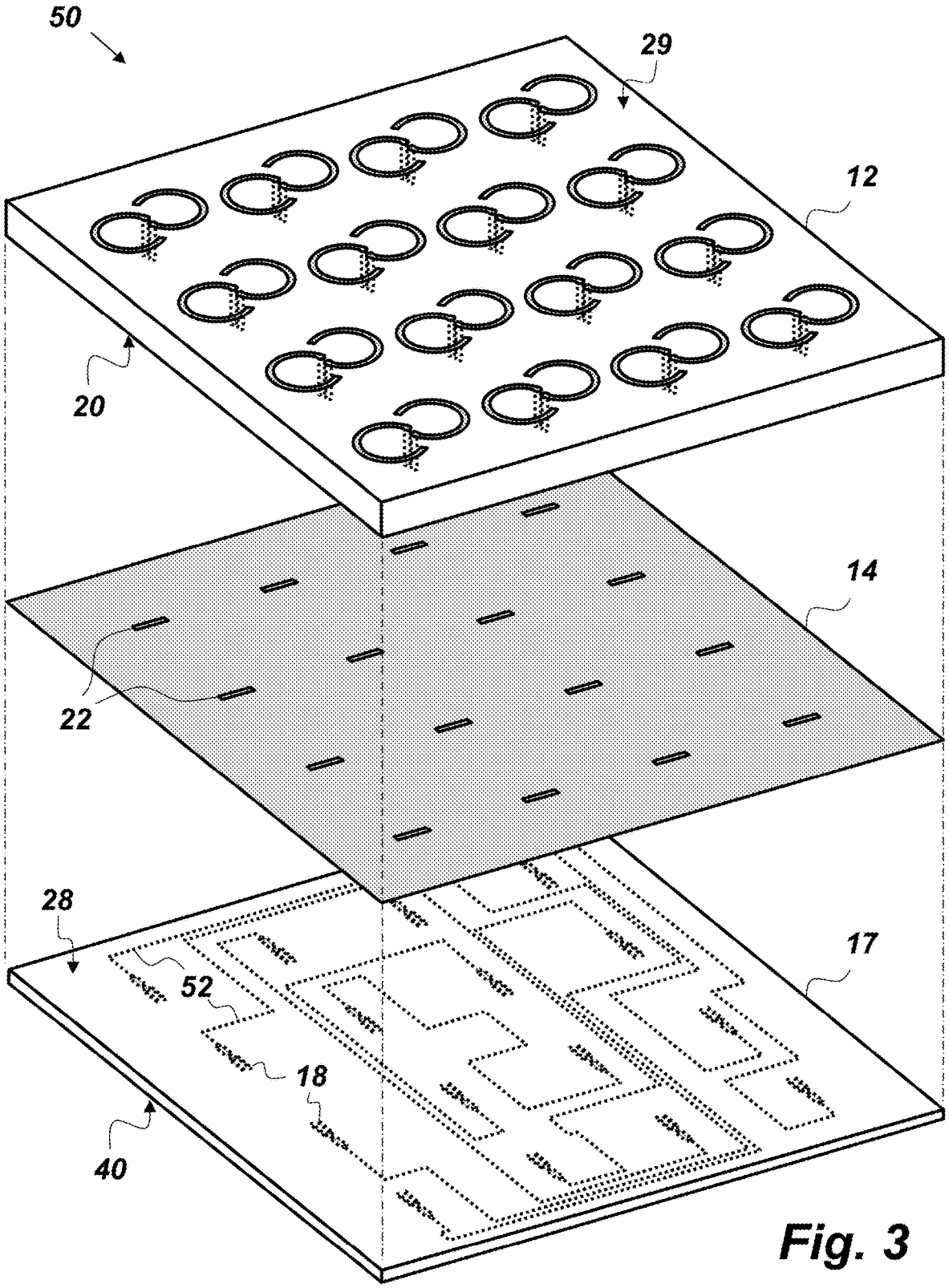
FIG. 3 is an expanded, perspective-view of an embodiment of a slot-fed antenna array configured as a retro-reflector.

FIG. 3 is an expanded-view illustration of a passive, RF, retro-reflective antenna array 50 comprising sixteen slot-fed antennas 10. The antennas 10 shown in FIG. 3 are connected via transmission lines 52, each of which terminates in a forked feed 18. The transmission lines 52 may be impedance-matched to 50 ohms. The lengths of the several transmission lines 52 may be multiple wavelengths of the desired operating frequency. For example, in one embodiment, the transmission lines 52 are multiple wavelengths of a center frequency of the passive, RF, retro-reflective antenna array 50. It is preferable that the transmission lines 52 are kept to minimum length possible to reduce loss. It is also preferable to allow maximum spacing between transmission lines 52 to avoid excessive coupling.

Figure 4:
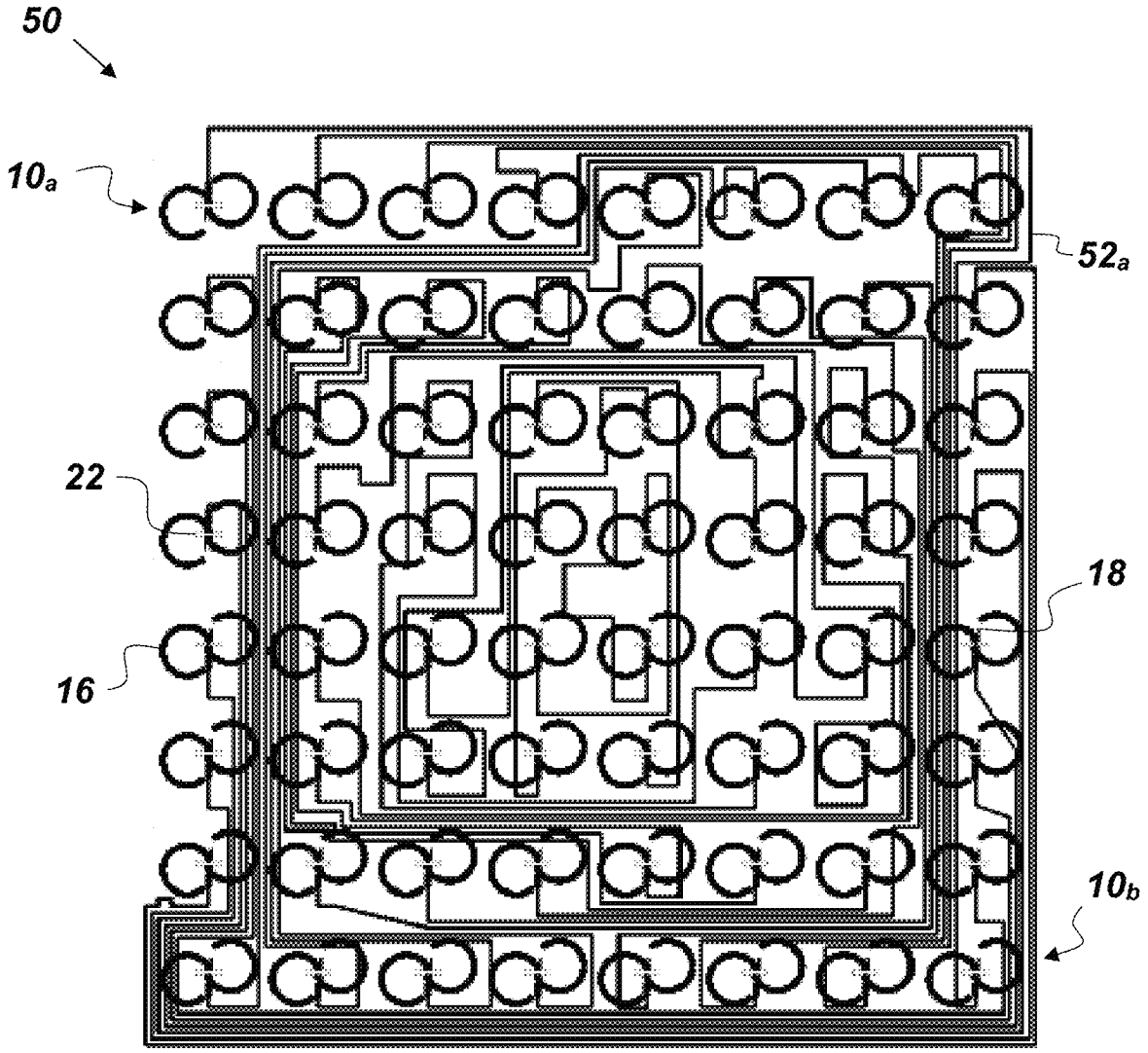
FIG. 4 is a top-view of an embodiment of a slot-fed antenna array configured as a retro-reflector.

FIG. 4 is a top, transparent-view illustration of an embodiment of the antenna array 50 having 64 constituent slot-fed antennas 10. In this view, the first and second dielectric layers and the slot layer are transparent to facilitate top-viewing of the components of each slot-fed antenna 10 and the connecting transmission lines 52. As shown in FIG. 4, each slot-fed antenna 10 is connected to another slot-fed antenna 10, one acting as a receiving antenna and the connected antenna acting as the transmitting antenna or vice versa. For example, slot-fed antenna $\mathbf{10}_a$ is connected to slot-fed antenna $\mathbf{10}_b$ via transmission line $\mathbf{52}_a$.

The following equations represent the behavior of the passive, RF, retro-reflective antenna array 50:

$$\Phi TxAnt=\Phi RxAnt=-90deg=-\Pi/2 \quad \text{(Eq. 1)}$$

In Equation 1, ΦTxAnt is the phase of a transmitting antenna, ΦRxAnt is the phase of a receiving antenna, and 2Π 360° at a center frequency of the RF, retro-reflective antenna array 50.

$$\Phi Pair=\Phi RxAnt+\Phi TxAnt-\beta l=-(\Pi/2+2\Pi m) \quad \text{(Eq. 2)}$$

In equation 2, ΦPair is the phase of a connected pair of slot-fed antennas 10 (such as $\mathbf{10}_a$ and $\mathbf{10}_b$ shown in FIG. 4), β is a frequency-dependent variable, l is a length of the connecting transmission line 52 (such as $\mathbf{52}_a$ shown in FIG. 4), and m is a multiple of the center frequency.

$$-\beta l=-\Phi RxAnt-\Phi TxAnt-\Pi/2-2\Pi m \quad \text{(Eq. 3)}$$

$$-\beta l=\Pi/2+\Pi/2-\Pi/2-2\Pi m \quad \text{(Eq. 4)}$$

$$-\beta l=\Pi/2-2\Pi m=(\Pi/2-2\Pi)-2\Pi m \quad \text{(Eq. 5)}$$

$$-\beta l=-3\Pi/2-2\Pi m \text{ or } -\beta l=-270\text{deg}-2\Pi m \quad \text{(Eq. 6)}$$

Equations 3-6 illustrate how the electrical length of a transmission line must be −270 deg−2 Πm.

Figure 5:
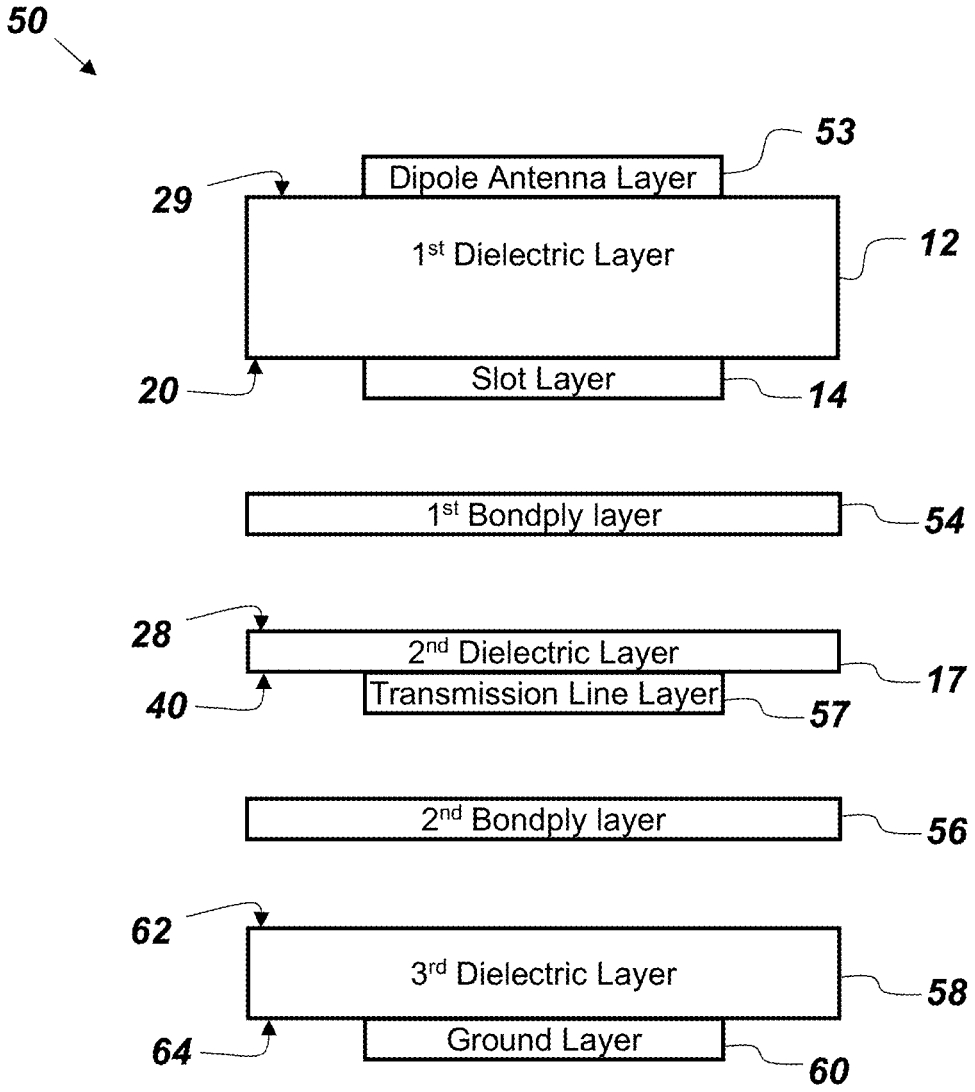
FIG. 5 is an expanded, side-view of an embodiment of a slot-fed antenna array.

FIG. 5 is a side-view, expanded illustration of an embodiment of the passive, RF, retro-reflective antenna array 50 that comprises a dipole antenna layer 53 (in which the arcs 16 are formed), first and second bondply layers 54 and 56, a transmission line layer 57 (from which the transmission lines 52 and forked feeds 18 are formed), a third dielectric layer 58, and a ground layer 60. The dipole antenna layer 53 is disposed on the top surface 29 of the first dielectric layer 12. In this embodiment, the first bondply layer 54 is an adhesive layer that adheres the slot layer 14 to the top surface 28 of the second dielectric layer 17. The transmission line layer 57 is disposed on the bottom surface 40 of the second dielectric layer 17. The second bondply layer 56 is an adhesive layer disposed to adhere the transmission line layer 57 to a top surface 62 of the third dielectric layer 58. The ground layer 60 is disposed on a bottom surface 64 of the third dielectric layer 58.

The following is a description of the materials and dimensions of one embodiment of the passive, RF, retro-reflective antenna array 50 shown in FIG. 5. In this embodiment, the first and third dielectric layers 12 and 58 are made of PCB material (such as Rogers RO3003™ produced by the Rogers Corporation) having respective thicknesses of 2159 micrometers (μm) (85 thousandths of an inch) and 635 μm (25 thousandths of an inch). The second dielectric layer in this embodiment is also made of PCB material (such as Rogers XT/Duroid® 8100 produced by the Rogers Corporation) having a thickness of 50 μm (2 thousandths of an inch). The first and second bondply layers 54 and 56 in this embodiment are unreinforced, thermoset based thin film adhesives (such as Rogers 2929 bondply produced by Rogers Corporation). Finally, in this embodiment, the dipole antenna layer 53, the slot layer 14, the transmission line layer 57, and the ground layer 60 are made of printed copper having of thickness of 34.79 μm (1.37 thousandths of an inch or ½ oz).

From the above description of the slot-fed antenna 10, it is manifest that various techniques may be used for implementing the concepts of the antenna without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the slot-fed antenna 10 is not limited to the particular embodiments described herein, but is capable of many embodiments without departing from the scope of the claims.

We claim:

1. An antenna comprising:

first and second dielectric layers;

a conductive slot layer disposed between a bottom surface of the first dielectric layer and a top surface of the second dielectric layer, wherein the slot layer has a slot therein, wherein the slot has short and long axes of symmetry;

a pair of arcs made of conductive material and disposed on a top surface of the first dielectric layer, wherein the arcs are rotated 180° from each other and each arc has a distal end and a proximal end, the proximal ends being vertically-aligned with the short axis of symmetry and equidistant from the long axis of symmetry, and wherein the proximal ends are electrically connected to the slot layer through vias in the first dielectric layer; and a forked feed made of conductive material disposed on a bottom surface of the second dielectric layer, wherein the forked feed has a centerline that is vertically-aligned with the short axis of symmetry.

2. The antenna of claim 1, wherein the arcs are elliptical.

3. The antenna of claim 1, wherein the arcs are circular.

4. The antenna of claim 3, wherein each circular arc subtends an angle of approximately 270°±25° at the center of a circle.

5. The antenna of claim 1, wherein the arcs are shaped like calk-less horse-shoes.

6. The antenna of claim 2, wherein the slot is rectangular.

7. The antenna of claim 6, wherein the proximal ends of the arcs are offset from each other by greater than a width of the rectangular slot.

8. The antenna of claim 7, wherein the forked feed has a forked section disposed under the rectangular slot.

9. The antenna of claim 8, wherein the arcs are made of gold-plated copper.

10. The antenna of claim 9, wherein the forked feed and the slot layer are made of copper.

11. The antenna of claim 8, wherein the arcs are oriented so as to provide right-handed circular polarization.

12. The antenna of claim 8, wherein the arcs are oriented so as to provide left-handed circular polarization.

13. The antenna of claim 8, wherein the arcs are oriented so as to provide elliptical polarization.

14. The antenna of claim 8, further comprising a plurality of antennas, wherein each of the plurality of antennas is identical to the antenna, and wherein the plurality of antennas are disposed with respect to each other to form a passive retro-reflective antenna array such that no power sources other than incoming RF energy is required for the passive retro-reflective antenna array to generate a return RF signal in the direction of the incoming RF energy.

15. An antenna comprising:

a slot layer having a rectangular slot cut therein, a pair of conductive arcs separated from the slot layer by a first dielectric layer, wherein proximal ends of the arcs are connected to the slot layer through vias in the first dielectric layer, and wherein the arcs are shaped and oriented with respect to each other and the rectangular slot so as to induce circular polarization and to function as an impedance matching device between the slot layer and air/space; and a feed conductor separated from the slot layer by a second dielectric layer such that the slot layer is disposed between the first and second dielectric layers, wherein the feed conductor is shaped and oriented with respect to the rectangular slot so as to function as an impedance matching device between incoming radio frequency radiation (RF) and the rectangular slot.

16. The antenna of claim 15, wherein each arc comprises a distal end that is positioned on the first dielectric layer with respect to the rectangular slot so as to cancel out an energy field emanating from the rectangular slot such that there is minimal frequency interaction between the distal ends and the rectangular slot.

17. The antenna of claim 16, further comprising a plurality of antennas, wherein each of the plurality of antennas is identical to the antenna, and wherein the plurality of antennas are disposed with respect to each other to form a passive retro-reflective antenna array such that no power sources other than incoming RF energy is required for the passive retro-reflective antenna array to generate a return RF signal in the direction of the incoming RF energy.

18. A passive, RF, retro-reflective antenna array comprising:

a first dielectric layer having top and bottom surfaces;

a plurality of arc-shaped antenna element pairs disposed on the top surface of the first dielectric layer;

a conductive slot layer disposed on the bottom surface of the first dielectric layer, wherein a slot is formed in the slot layer under each arc-shaped antenna element pair, and wherein each arc-shaped antenna element pair is electrically connected through vias to the slot layer;

a second dielectric layer having top and bottom surfaces, wherein the slot layer is disposed between the top surface of the second dielectric layer and the bottom layer of the first dielectric layer; and a transmission line layer disposed on the bottom surface of the second dielectric layer, wherein 50 Ohm transmission lines are formed in the transmission line layer, and wherein each transmission line terminates in a forked feed structure and corresponds to, and is aligned with, a separate arc-shaped antenna element pair.

19. The passive, RF, retro-reflective antenna array of claim 18, further comprising:

a third dielectric layer having top and bottom surfaces, wherein the transmission line layer is disposed between the top surface of the third dielectric layer and the bottom surface of the second dielectric layer; and a ground plane disposed on the bottom surface of the third dielectric layer.

20. The passive, RF, retro-reflective antenna array of claim 19, wherein the transmission line lengths are kept to multiple wavelengths of a center frequency of the passive, RF, retro-reflective antenna array.

* * * * *